US007324629B2

(12) United States Patent
Fukushima et al.

(10) Patent No.: US 7,324,629 B2
(45) **Date of Patent: *Jan. 29, 2008**

(54) ROTARY ANODE TYPE X-RAY TUBE

(75) Inventors: Harunobu Fukushima, Tokyo (JP); Yasuo Yoshii, Kawasaki (JP); Hitoshi Hattori, Yokohama (JP); Koichi Kitade, Otawara (JP); Mitsuo Iwase, Nasu-gun (JP); Hironori Nakamuta, Otawara (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/564,152

(22) Filed: Nov. 28, 2006

(65) Prior Publication Data

US 2007/0092063 A1 Apr. 26, 2007

Related U.S. Application Data

(63) Continuation of application No. 10/927,105, filed on Aug. 27, 2004, now Pat. No. 7,215,740.

(30) Foreign Application Priority Data

Aug. 29, 2003 (JP) ..... 2003-307392

(51) Int. Cl.
*H01J 35/10* (2006.01)

(52) U.S. Cl. ..... 378/126; 378/132

(58) Field of Classification Search ..... 378/125, 378/126, 131, 132, 144

See application file for complete search history.

(56) References Cited

U.S. PATENT DOCUMENTS

| | | | |
|---|---|---|---|
| 3,758,801 | A | 9/1973 | Merritt |
| 4,644,577 | A | 2/1987 | Gerkema et al. |
| 5,185,774 | A | 2/1993 | Klostermann |
| 5,224,142 | A | 6/1993 | Ono et al. |
| 5,822,395 | A | 10/1998 | Schardt et al. |
| 5,838,763 | A | 11/1998 | Hiller et al. |
| 6,314,161 | B1 | 11/2001 | Anno |
| 7,012,989 | B2 | 3/2006 | Holland et al. |
| 2002/0085676 | A1 | 7/2002 | Snyder |

FOREIGN PATENT DOCUMENTS

| | | |
|---|---|---|
| JP | 3139873 | 12/2000 |
| JP | 2001-236908 | 8/2001 |
| JP | 2003-16980 | 1/2003 |

*Primary Examiner*—Chih-Cheng G Kao
(74) *Attorney, Agent, or Firm*—Oblon, Spivak, McClelland, Maier & Neustadt, P.C.

(57) ABSTRACT

In a rotary anode type X-ray tube, a rotary anode and a rotary structure supporting the anode are arranged within the vacuum envelope. A stationary shaft has a middle section which is fitted into a cylindrical portion of the rotary structure, and a dynamic pressure type radial bearing is arranged between the cylindrical portion and the middle section. The stationary shaft also has a first section between one end of the middle section and one end of the stationary shaft, and a second section between the other end of the middle section and the other end of the stationary shaft, which are fixed to the vacuum envelope. A transverse stiffness of the second section is set to be larger than a transverse stiffness of the first section, and a center of gravity is positioned in the middle section.

11 Claims, 5 Drawing Sheets

ROTARY ANODE TYPE X-RAY TUBE

CROSS-REFERENCE TO RELATED APPLICATIONS

This application is a continuation of and is based upon and claims the benefit of priority under 35 U.S.C. §120 from U.S. Ser. No. 10/927,105, now U.S. Pat. No. 7,215,740 filed on Aug. 27, 2004, and claims the benefit of priority under 35 U.S.C. §119 from Japanese Patent Application No. 2003-307392, filed Aug. 29, 2003, the entire contents of which are incorporated herein by reference.

BACKGROUND OF THE INVENTION

1. Field of the Invention

The present invention relates to a rotary anode type X-ray tube, particularly, to a rotary anode type X-ray tube in which the rotary shaft is supported by a dynamic slide bearing.

2. Description of the Related Art

The conventional rotary anode type X-ray tube is disclosed in Japanese Patent No. 3,139,873 and U.S. Pat. No. 5,838,763 and, thus, is already known to the public. In the rotary anode type X-ray tube disclosed in Japanese Patent No. 3,139,873, an electron beam generated from the cathode is impinged on a rotary anode that is rotated as a target so as to cause X-rays to be emitted from the rotary anode. The rotary anode is fixed to a cylindrical rotary structure, and the rotary shaft of the rotary structure is supported in a rotatable condition, by a dynamic slide bearings arranged between the rotary shaft and a stationary shaft. The stationary shaft is fixed to and supported by a supporting-fixing section arranged within a vacuum envelope so as to extend within the vacuum envelope. A cylindrical rotary structure having a heavy rotary anode mounted thereto is fitted to the tip of the stationary shaft with the dynamic slide bearings interposed therebetween.

The rotary anode type X-ray tube having a cantilever beam structure described above is fixed to a gantry of a CT apparatus. The gantry is rotated around a subject to be diagnosed so that the X-ray tube is moved around the subject. A centrifugal force is imparted to the rotary anode type X-ray tube in accordance with rotating movement of the rotary anode type X-ray tube. Thus, a particularly large centrifugal force is imparted to a heavy rotary anode type X-ray tube containing an alloy of a heavy metal as a main component. The centrifugal force applied to the rotary anode is imparted to a rotary structure, and the rotary structure imparts a large bending moment to the supporting-fixing section. As a result, supporting-fixing section and the stationary shaft are bent about the supporting-fixing section so as to bring about displacement of the rotary anode. Such being the situation, a relative slight movement is generated between the rotary anode and the cathode so as to cause the electron beam to be defocused and to be incident on the rotary anode. Alternatively, the focal point of the electron beam is shifted. As a result, it is possible for the rotary anode type X-ray tube to fail to emit an X-ray with a high accuracy. It should also be noted that the rotation of the rotary structure is rendered unstable so as to markedly shorten the life of the rotary anode type X-ray tube.

In the conventional rotary anode type X-ray tube having a cantilever beam structure, the rigidity of each of the stationary shaft, the supporting-fixing section, and the vacuum envelope is increased so as to prevent each of these members of the rotary anode type X-ray tube from being deformed by the centrifugal force. However, if the rigidity of each of these members is increased, the size and the weight of each of these members are increased so as to give rise to the problem that the entire apparatus is rendered bulky.

In the rotary anode type X-ray tube disclosed in U.S. Pat. No. 5,838,763, both sides of the stationary shaft are supported by and fixed to a pair of supporting-fixing portions mounted in a vacuum envelope. The stationary shaft is fitted into the cylindrical rotary structure having a heavy rotary anode mounted thereto, and the rotary shaft is supported, by dynamic slide bearings arranged between the rotary shaft and the stationary shaft, in such a manner that the rotary shaft is rotated around the stationary shaft.

In this rotary anode type X-ray tube having a both-side supported beam structure, which is disclosed in the U.S. Patent quoted above, the stationary shaft is coupled to a vacuum envelope by supporting-fixing sections mounted at both edges of the stationary shaft. In this structure, the centrifugal force generated during the rotation of the X-ray tube around the subject to be diagnosed is dispersed to the pair of the supporting-fixing sections so as to decrease the deformations of the pair of the supporting-fixing sections and the stationary shaft. It follows that the defocusing of the electron beam is prevented. Also, the particular structure permits increasing the natural frequency so as to obtain a stable rotation even if the number of rotations per unit time is increased, compared with the structure disclosed in Japanese Patent No. 3,139,873 in which the rotary structure is rotated and mounted on the side of the free edge of the stationary shaft. It follows that, according to the both-side supported beam structure disclosed in U.S. Pat. No. 5,838,763, it is possible to increase the number of rotations per unit time of the rotary anode so as to obtain the merit that the temperature on the focal plane of the anode can be lowered.

In the both-side supported beam structure, however, a desired degree of parallelism between the stationary shaft and the cylindrical rotary structure is collapsed by the centrifugal force F acting on a heavy rotary anode, with the result that the cylindrical rotary structure tends to fail to be rotated smoothly. Also, since the stationary shaft is supported by a pair of supporting-fixing sections, the stationary shaft is deformed in a manner to depict a displacement curve having a single peak between the two supporting-fixing sections, if the centrifugal force is applied to the rotary structure. As a result, depending on the position of the peak of the displacement curve, the degree of parallelism between the stationary shaft and the cylindrical rotary structure is rendered poor in the bearing region in which a radial bearing and a thrust bearing are to be formed. As a matter of fact, a partial contact is brought about between the stationary shaft and the cylindrical rotary structure so as to give rise to, for example, seizing. It follows that the reliability of the bearing is lowered.

BRIEF SUMMARY OF THE INVENTION

An object of the present invention is to provide a rotary anode type X-ray tube having a high reliability, which can be rotated smoothly and stably.

According to an aspect of the present invention, there is provided a rotary anode type X-ray tube, comprising:

a vacuum envelope;

a cathode arranged within the vacuum envelope, which emits an electron beam;

a rotary anode arranged within the vacuum envelope, on which the electron beam is impinged to generate X-rays;

a rotary structure supporting the rotary anode, including a cylindrical portion having two open ends and a rotor section provided for generating a rotating force to rotate the cylindrical portion together with the rotary anode, and arranged within the vacuum envelope, the center of gravity of the rotary anode with the rotary structure being set therein;

a stationary shaft having two ends, a middle section having two ends, which is fitted into the cylindrical portion, a first section between one end of the middle section and one end of the stationary shaft, and a second section between the other end of the middle section and the other end of the stationary shaft, a transverse stiffness of the second section being larger than a transverse stiffness of the first section, and the center of gravity being positioned in the middle section;

a dynamic pressure type radial bearing arranged between the cylindrical portion and the middle section of the stationary shaft; and first and second supporting sections arranged within and fixed to the vacuum envelope, configured to support the first section and the second section of the stationary shaft within the vacuum envelope.

According to another aspect of the present invention, there is provided a computed tomography apparatus comprising:

a rotary anode type X-ray tube including:

a vacuum envelope;

a cathode arranged within the vacuum envelope, which emits an electron beam;

a rotary anode arranged within the vacuum envelope, on which the electron beam is impinged to generate X-rays;

a rotary structure supporting the rotary anode, including a cylindrical portion having two open ends and a rotor section provided for generating a rotating force to rotate the cylindrical portion together with the rotary anode, and arranged within the vacuum envelope, the center of gravity of the rotary anode with the rotary structure being set therein;

a stationary shaft having two ends, a middle section having two ends, which is fitted into the cylindrical portion, a first section between one end of the middle section and one end of the stationary shaft, and a second section between the other end of the middle section and the other end of the stationary shaft, a transverse stiffness of the second section being larger than a transverse stiffness of the first section, and the center of gravity being positioned in the middle section;

a dynamic pressure type radial bearing arranged between the cylindrical portion and the middle section of the stationary shaft; and first and second supporting sections arranged within and fixed to the vacuum envelope, configured to support the first section and the second section of the stationary shaft within the vacuum envelope.

According to yet another aspect of the present invention, there is provided a rotary anode type X-ray tube, comprising:

a vacuum envelope;

a cathode arranged within the vacuum envelope, which emits an electron beam;

a rotary anode arranged within the vacuum envelope, on which the electron beam is impinged to generate X-rays;

a rotary structure supporting the rotary anode, including a cylindrical portion having two open ends and a rotor section provided for generating a rotating force to rotate the cylindrical portion together with the rotary anode, and arranged within the vacuum envelope, the center of gravity of the rotary anode with the rotary structure being set therein;

a stationary shaft having two ends, a middle section having two ends, which is fitted into the cylindrical portion, a first section between one end of the middle section and one end of the stationary shaft, and a second section between the other end of the middle section and the other end of the stationary shaft, the middle section being located between the first and the second sections, and the center of gravity being positioned in the middle section;

a dynamic pressure type radial bearing arranged between the cylindrical portion and the middle section of the stationary shaft; and first and second supporting sections arranged within and fixed to the vacuum envelope, configured to support the first section and the second section of the stationary shaft within the vacuum envelope, the first section of the stationary shaft is capable of tilting at the first supporting section.

According to further aspect of the present invention, there is provided a computed tomography apparatus comprising:

a rotary anode type X-ray tube, including: a vacuum envelope;

a cathode arranged within the vacuum envelope, which emits an electron beam;

a rotary anode arranged within the vacuum envelope, on which the electron beam is impinged to generate X-rays;

a rotary structure supporting the rotary anode, including a cylindrical portion having two open ends and a rotor section provided for generating a rotating force to rotate the cylindrical portion together with the rotary anode, and arranged within the vacuum envelope, the center of gravity of the rotary anode with the rotary structure being set therein;

a stationary shaft having two ends, a middle section having two ends, which is fitted into the cylindrical portion, a first section between one end of the middle section and one end of the stationary shaft, and a second section between the other end of the middle section and the other end of the stationary shaft, the middle section being located between the first and the second sections, and the center of gravity being positioned in the middle section;

a dynamic pressure type radial bearing arranged between the cylindrical portion and the middle section of the stationary shaft; and first and second supporting sections arranged within and fixed to the vacuum envelope, configured to support the first section and the second section of the stationary shaft within the vacuum envelope, the first section of the stationary shaft is capable of tilting at the first supporting section.

DETAILED DESCRIPTION OF THE INVENTION

The rotary anode type X-ray tubes according to various embodiments of the present invention will now be described with reference to the accompanying drawings.

Figure 1:
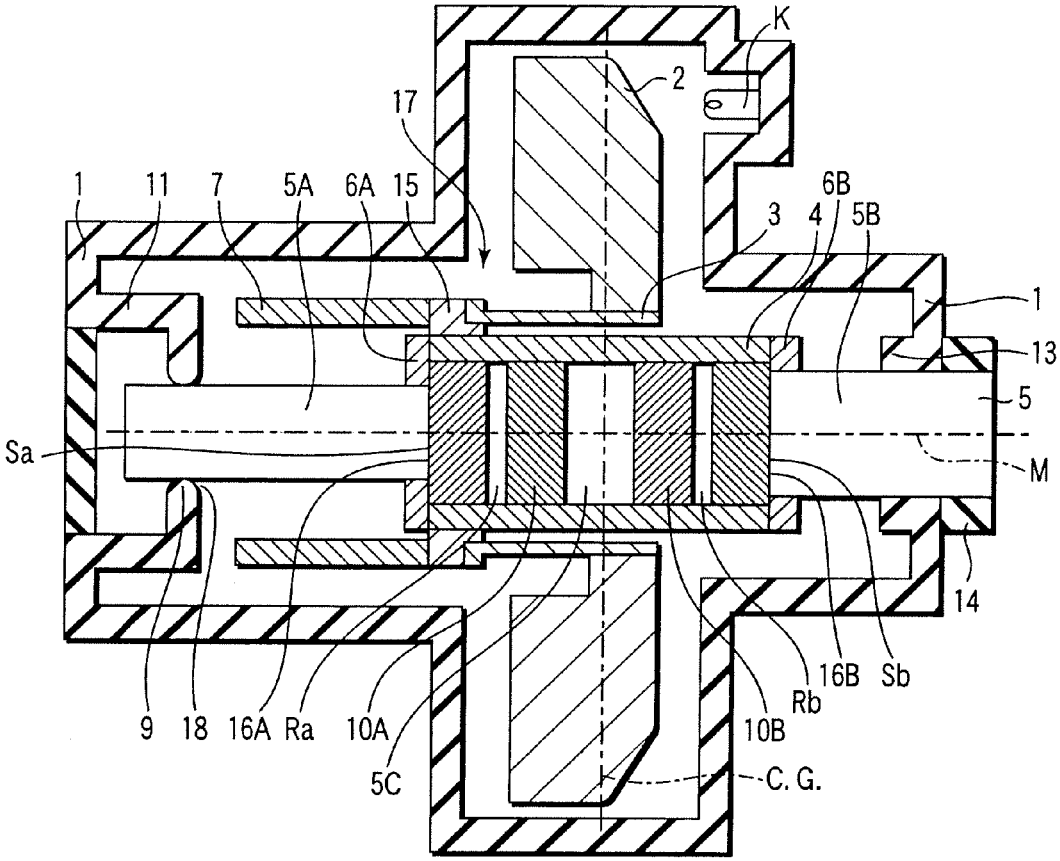
FIG. 1 is a cross sectional view schematically showing the construction of a rotary anode type X-ray tube according to a first embodiment of the present invention.

FIG. 1 is a cross sectional view schematically showing the construction of a rotary anode type X-ray tube according to a first embodiment of the present invention.

As shown in FIG. 1, the rotary anode type X-ray tube of the present invention comprises a vacuum envelope 1 and a rotary anode 2 received in the vacuum envelope 1. The rotary anode 2 is rotated and used as a target. An electron beam emitted from a cathode K is impinged on the rotary anode 2 so as to cause an X-ray to be emitted from the rotary anode 2. The rotary anode 2 is fixed to a cylindrical coupling section 3 and is joined to a cylindrical portion 4 via the cylindrical coupling section 3 and a member 15 for allowing the cylindrical coupling section 3 to be mounted to the cylindrical portion 4.

A rotary structure 17 provided with the rotary anode 2 fixed thereto and including a rotor section 7, the coupling section 3, the mounting member 15 and the cylindrical portion 4 is supported in a rotatable condition by radial bearings Ra and Rb arranged between the inner surface of the cylindrical portion 4 and the outer surface of a stationary shaft 5 and by thrust bearings Sa and Sb arranged between sealing members 6A, 6B for sealing the openings of the cylindrical portion 4 and stepped surfaces 16A, 16B of the stationary shaft 5, respectively.

The stationary shaft 5 has one end and the other end, a first section 5A formed between one end of the stationary shaft 5 and the radial bearing Ra, a second section 5B formed between the other end of the stationary shaft 5 and the radial bearing Rb, and a middle section 5C formed between the first and the second sections. It follows that the radial bearings Ra, Rb are formed between the outer surface of the middle section 5C and the inner surface of the cylindrical portion 4. In other words, the middle section 5C is fitted into the cylindrical portion 4.

Grooves for the dynamic pressure type radial bearings Ra, Rb, e.g., spiral grooves 10A, 10B, are formed on the outer circumferential surface of the middle section 5C of the stationary shaft 5. Also, grooves for the dynamic pressure type thrust bearings Sa, Sb, e.g., spiral grooves (not shown), are formed on the surface of the sealing member 6A facing the stepped surface 16A formed on the stationary shaft 5 and on the stepped surface 16B of the stationary shaft 5 positioned to face the surface of the sealing member 6B. A liquid metal lubricant is supplied into each of these spiral grooves, into the small gap between the inner surface of the cylindrical portion 4 and the outer surface of the stationary shaft 5, and into the small gap between the sealing members 6A, 6B and the stepped surface 16A, 16B of the stationary shaft 5 so as to form the dynamic pressure type slide bearings (radial bearings) Ra, Rb and the dynamic pressure type slide bearings (thrust bearings) Sa, Sb between the cylindrical portion 4 or the sealing members 6A, 6B and the stationary shaft 5. A dynamic pressure is generated within the liquid metal lubricant housed in each of these dynamic pressure type slide bearings Ra, Rb, Sa and Sb in accordance with rotation of the cylindrical portion 4, with the result that the cylindrical portion 4 is rotatably supported by the slide bearings Ra, Rb, Sa and Sb.

As described above, the stationary shaft 5 has the first section 5A extending from the middle section 5C to the left side in FIG. 1, the second section 5B extending from the middle section 5C to the right side in FIG. 1. These sections 5A and 5B is extended to the vacuum envelope 1 and supported by the vacuum envelope 1. The vacuum envelope 1 includes a supporting section 11 for supporting and holding the first section 5A and a supporting section 13 for supporting and holding the second section 5B.

The rotor section 7 is mounted to the mounting section 15. The rotor section 7 is formed of a conductor having a small electrical resistance such as copper. An electromagnet (not shown) is mounted on the vacuum envelope 1. An eddy current is generated in the rotor section 7 by the magnetic field generated from the electromagnet, and a rotating force is generated in the rotor section 7 by the interaction between the eddy current and the magnetic field generated from the electromagnet so as to rotate the rotary structure 17.

The center of gravity C.G. on a rotary axis M of the rotating body including the rotary anode 2 and the rotary structure 17 is positioned in a region between the two radial bearings Ra and Rb. Where the rotary structure 17 is supported by a single radial bearing, the center of gravity C.G. is positioned in a region on the radial bearing. The center of gravity C.G. is positioned within the rotary anode 2 because the rotary anode 2 is sufficiently heavy, compared with the rotary structure 17, and the line of the center of gravity passing through the center of gravity C.G. and denoted by a dot-and-bar line perpendicular to the rotary axis M extends within the rotary anode 2.

The first section 5A of the stationary shaft 5 is supported by a supporting and holding structure 9 formed in the supporting section 11 of the vacuum envelope 1. The supporting and holding structure 9 can supports the first section 5A securely under the loaded condition during operation of the rotary anode type X-ray tube. A gap 18 is provided between the supporting and holding structure 9 and the first section 5A. For example, the supporting and holding structure 9 has an annular section facing the first section SA, the shape of the annular section on a cross sectional plane along the rotary axis M has a curved shape. It follows that the first section 5A is designed to be capable of tilting about the annular section, which acts as a fulcrum, of the supporting section 11. In other words, the annular section and the first section 5A are tangentially brought into contact with each other in a sufficiently small contact region so as to permit the first section 5A to be supported by the supporting and holding structure 9. Such being the situation, the first section 5A is tilted with the contact region in the supporting and holding structure 9 acting as a fulcrum even if deformation is generated in the first section 5A. As a result, the direction of the first section 5A is simply changed so as to permit the supporting and holding structure 9 to hold the first section 5A without fail. In the structure shown in FIG. 1, the second section 5B of the stationary shaft 5 is hermetically fixed to the vacuum envelope 1 by a stationary member 14.

In the rotary anode type X-ray tube shown in FIG. 1, only the first section 5A is tangentially supported by the supporting and holding structure 9, and is capable of tilting with the supporting and holding structure 9 acting as a fulcrum. Alternatively, it is possible for only the second section 5B or for both the first section 5A and the second section 5B to be tangentially supported by the supporting and holding structure so as to be capable of tilting about the supporting and holding structure acting as a fulcrum.

Where the first section 5A is tangentially supported by the supporting and holding structure 9, the stationary shaft 5 is capable of sliding in its axial direction even if the stationary shaft 5 is thermally expanded in its axial direction so as to absorb the thermal expansion.

In the rotary anode type X-ray tube shown in FIG. 1, the size in the axial direction of the first section 5A between the thrust bearing Sa and the supporting and holding structure 9 is set larger than the size in the axial direction of the second section 5B between the thrust bearing Sb and the supporting section 13. Also, the first section 5A is designed such that the bending rigidity of the first section 5A is smaller than the bending rigidity of the second section 5B. For example, where the sections 5A and 5B are formed columnar as shown in FIG. 1, the bending rigidity of the first section 5A can be made smaller than the bending rigidity of the second section 5B by making the diameter of the first section 5A smaller than the diameter of the second section 5B. Incidentally, where the sections 5A and 5B are formed columnar as shown in FIG. 1, it is not absolutely necessary for the columnar sections 5A and 5B to be solid. It is possible for a void or a coolant passageway to be formed within the columnar sections 5A, 5B. The first section 5A and the second section 5B are formed as above, so that a transverse stiffness of the second section is larger than a transverse stiffness of the first section.

Where the rotary anode type X-ray tube of the construction described above is rotated by a gantry (not shown) of a CT apparatus, the centrifugal force in the radial direction, which acts on the center of gravity C.G. of the rotary body including the rotary anode and the rotary structure 17, is exerted on a region between the radial bearings Ra and Rb, with the result that the rotary structure 17 and the stationary shaft 5 are relatively displaced substantially in parallel. In other words, both the rotary structure 17 and the stationary shaft 5 are displaced in parallel while maintaining a desired degree of parallelism between the rotary structure 17 and the stationary shaft 5 so as to prevent a deviation in the degree of parallelism between the rotary structure 17 and the stationary shaft 5. In the conventional rotary anode type X-ray tube having a cantilever beam structure, the rotary structure is rotated eccentrically relative to the base section of the stationary shaft by the rotary anode receiving the centrifugal force, with the result that the rotary structure and the stationary shaft are rotationally displaced relative to each other. However, in the rotary anode type X-ray tube of the present invention shown in FIG. 1, the centrifugal force, even if imparted to the rotary body, acts substantially on the center of gravity C.G. so as to integrally displace the rotary structure 17 and the stationary shaft 5.

In the rotary anode type X-ray tube according to the first embodiment of the present invention described above:

(a) The rotary anode type X-ray tube includes the structure that the first section 5A can be tilted about the supporting section 11 of the vacuum envelope acting as a fulcrum;

(b) The size in the axial direction of the first section 5A between the thrust bearing Sa and the supporting and holding structure 9 is set larger than the size in the axial direction of the second section 5B between the thrust bearing Sb and the supporting section 13; and (c) The bending rigidity in the first section 5A is set smaller than the bending rigidity in the second section 5B and, thus, the first section 5A tends to be displaced and deformed more than the second section 5B will be.

Figure 2:
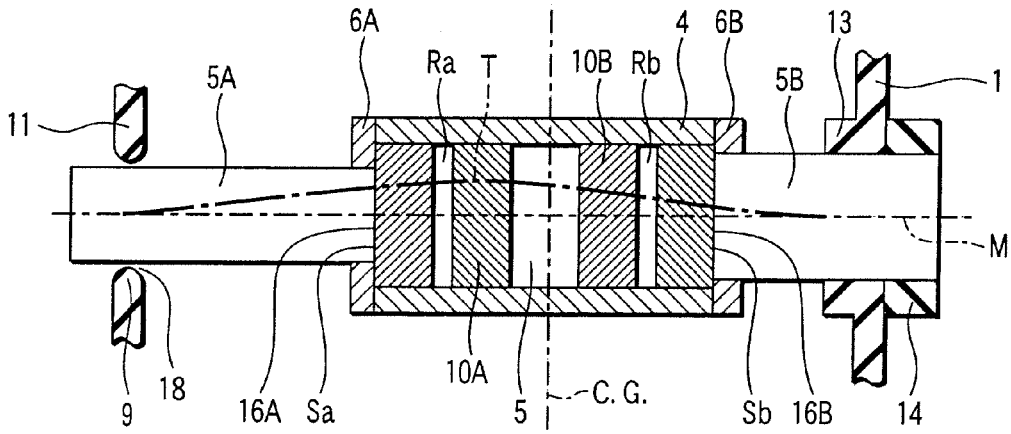
FIG. 2 is a cross sectional view schematically showing the supporting structure of the stationary shaft shown in FIG. 1 and the deformation curve of the stationary shaft due to the centrifugal force applied to the rotary structure.
Figure 3:
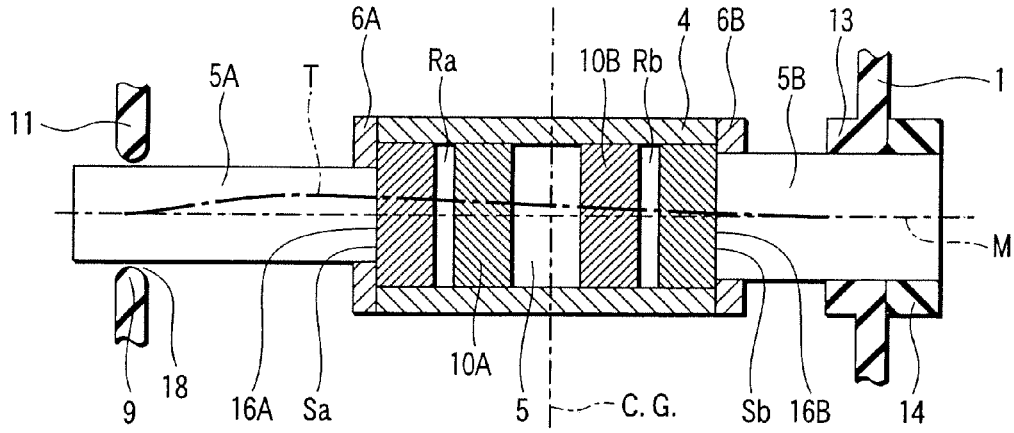
FIG. 3 is a cross sectional view schematically showing the supporting structure of the stationary shaft shown in FIG. 1 and the deformation curve of the stationary shaft due to the centrifugal force applied to the rotary structure.

The stationary shaft 5 is so deformed as to have the displacement curve in the above described configuration, as shown in FIG. 2, upon receipt of the centrifugal force in the radial direction from the rotary structure 17. The peak T in the deformation of the displacement curve is shifted to the left from the center of gravity C.G such that, for example, the peak T is positioned in the spiral groove region 10A or the vicinity of the spiral groove region 10A as shown in FIG. 2 or is positioned between the spiral groove region 10A and the supporting section 11 as shown in FIG. 3. As a result, a desired degree of parallelism between the rotary structure 17 and the stationary shaft 5 is maintained so as to suppress the fluctuation in the degree of parallelism to a low level.

Incidentally, in order to maintain a desired degree of parallelism between the rotary structure 17 and the stationary shaft 5, it suffices to employ at least one of the three constructions given above. It is also possible to employ two constructions in combination appropriately.

It is possible to move the peak T in the displacement amount of the deformation curve so as to maintain a desired degree of parallelism noted above. The particular possibility will now be described with reference to FIGS. 4 to 7 based on the analysis performed by the present inventors.

Figure 4:
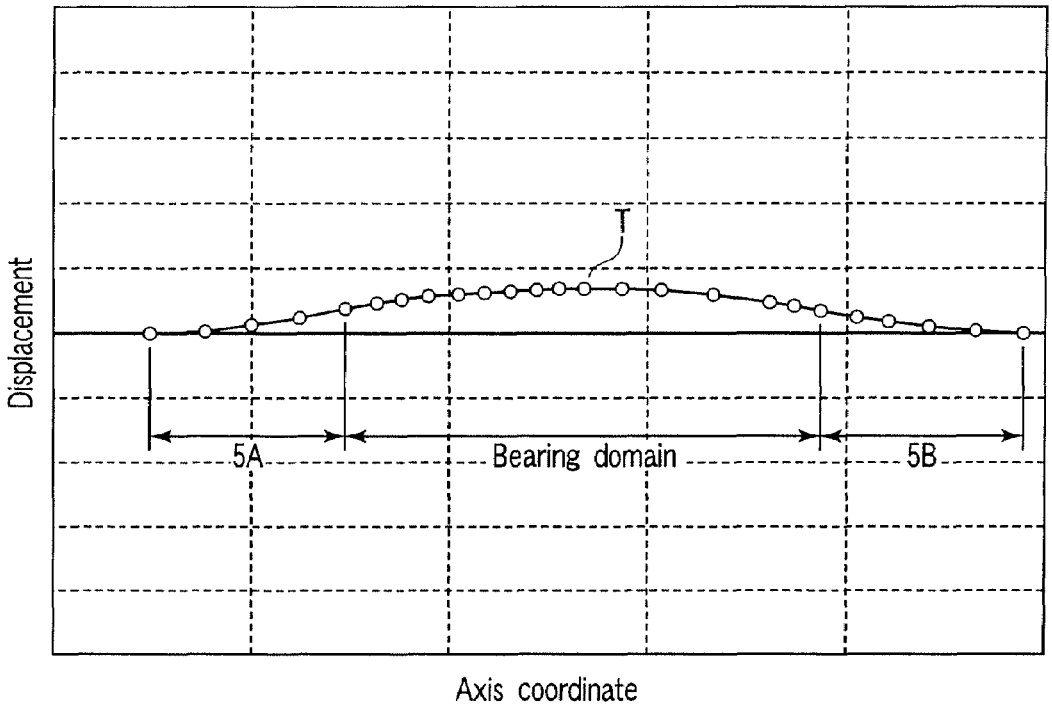
FIG. 4 is a graph schematically showing the deformation curve of the stationary shaft due to the centrifugal force applied to the rotary structure in a comparative configuration.

Each of FIGS. 4 to 7 is a graph showing the displacement of each portion on the stationary shaft 5, which is plotted on the ordinate, along the axis of the stationary shaft 5, which is plotted on the abscissa. FIG. 4 shows the displacement of the center axis of the stationary shaft 5 in the structure for the comparative case. In the comparative case, the two sections 5A and 5B are clamped stationary by the supporting sections 11 and 13 of the vacuum envelope 1 such that the sections 5A and 5B are incapable of tilting. In addition, the sections 5A and 5B are equal to each other in the size in the axial direction and in the bending rigidity. In the structure for this comparative case, the peak T in the displacement amount of the deformation curve is positioned substantially in the center of the two radial bearings Ra and Rb so as to be arranged on the line passing through the center of gravity C.G. of the rotary body.

Figure 5:
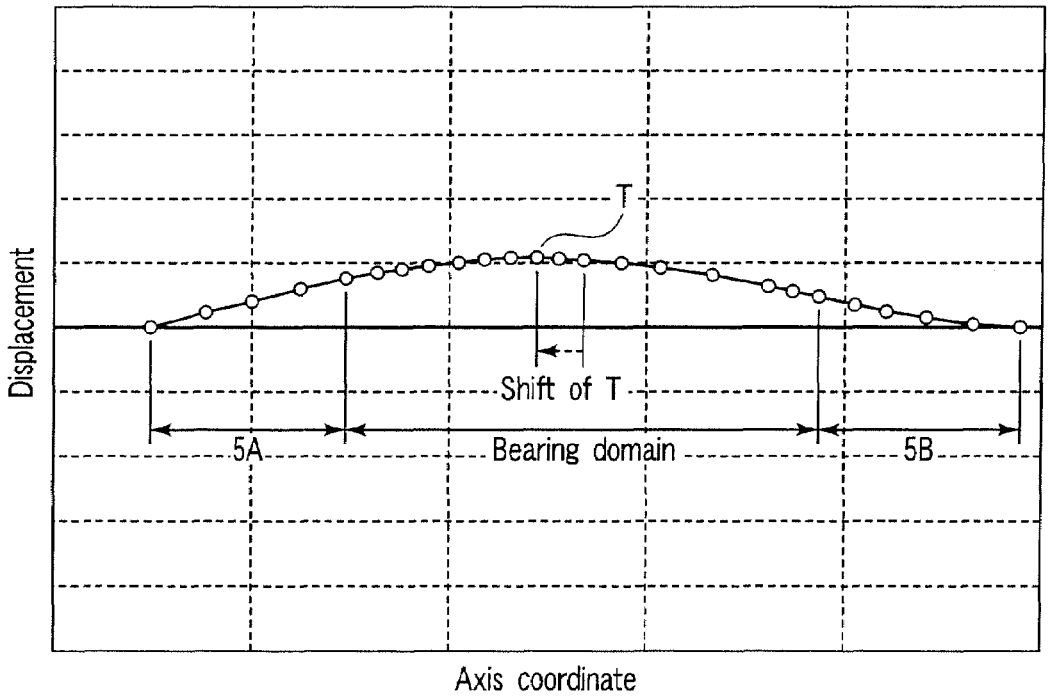
FIG. 5 is a graph schematically showing the deformation curve of the stationary shaft due to the centrifugal force applied to the rotary structure in a configuration that the stationary shaft is supported in such a way that the first section of the stationary shaft is capable of tilting as shown in FIG. 1.

FIG. 5 shows the deformation curve of the stationary shaft 5 in the structure in which the first section 5A is made capable of tilting about the supporting and holding structure 9 acting as a fulcrum as shown in FIG. 1 and FIG. 2. It should be noted that, in the structure in which the first section 5A is capable of tilting, only one of the two sections 5A and 5B, i.e., the first section 5A is capable of tilting about the fulcrum, and the second section 5B is held incapable of tilting by the supporting section 13, and that the sections 5A and 5B are equal to each other in the size in the axial direction and in the bending rigidity.

Compared with FIG. 4 showing the deformation curve for the comparative case, the peak T in the displacement amount of the deformation curve in the graph shown in FIG. 5 is shifted toward the tilted side (i.e., to the left in FIG. 5). To be more specific, the peak T in the displacement amount of the deformation curve is shifted from the center of gravity C.G. of the rotary body in the stationary stage of the rotary structure toward the supporting and holding structure 9. Also, if the average values of the relative inclination amount between the rotary structure 17 and the stationary shaft 5 at the radial bearings Ra and Rb are compared, the average value of the relative inclination amount shown in FIG. 5 is 83% of the average value of the relative inclination amount shown in FIG. 4. In other words, it can be understood that, even if the centrifugal force is applied to the rotary body, a desired degree of parallelism can be maintained between the rotary structure 17 and the stationary shaft 5.

Figure 6:
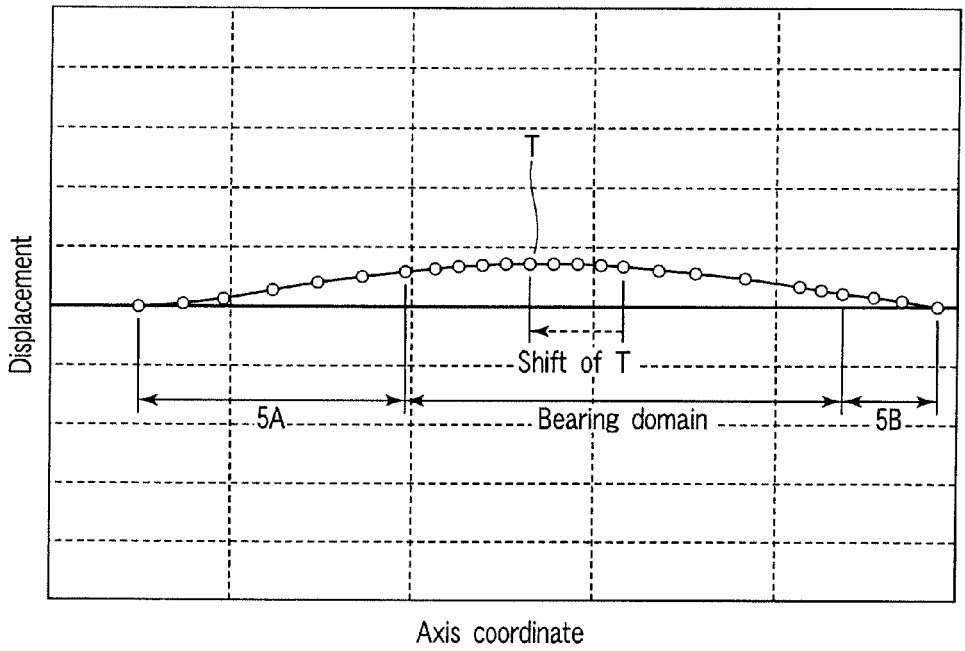
FIG. 6 is a graph schematically showing the deformation curve of the stationary shaft due to the centrifugal force applied to the rotary structure in a configuration that the stationary shaft is supported stationary and incapable of tilting and the first and second sections differ from each other in length as shown in FIG. 1.

FIG. 6 shows the deformation curve in the structure in which the size in the axial direction of the first section 5A is rendered larger than the size in the axial direction of the second section 5B. It should be noted, however, that the two sections 5A and 5B are clamped stationary by the supporting sections 11 and 13 of the vacuum envelope 1, respectively, such that the sections 5A and 5B are incapable of tilting. In addition, the sections 5A and SB are equal to each other in the bending rigidity.

Compared with FIG. 4 showing the deformation curve for the comparative case, the peak T in the displacement amount of the deformation curve is moved to the left in the graph shown in FIG. 6 as in the graph of FIG. 5. In the graph shown in FIG. 6, the average value of the relative inclination amount between the rotary structure 17 and the stationary shaft 5 is 73% of the average value of the relative inclination amount shown in FIG. 4 directed to the comparative case. Similarly, it can be understood that, even if the centrifugal force is applied to the rotary body, a desired degree of parallelism can be maintained between the rotary structure 17 and the stationary shaft 5.

Figure 7:
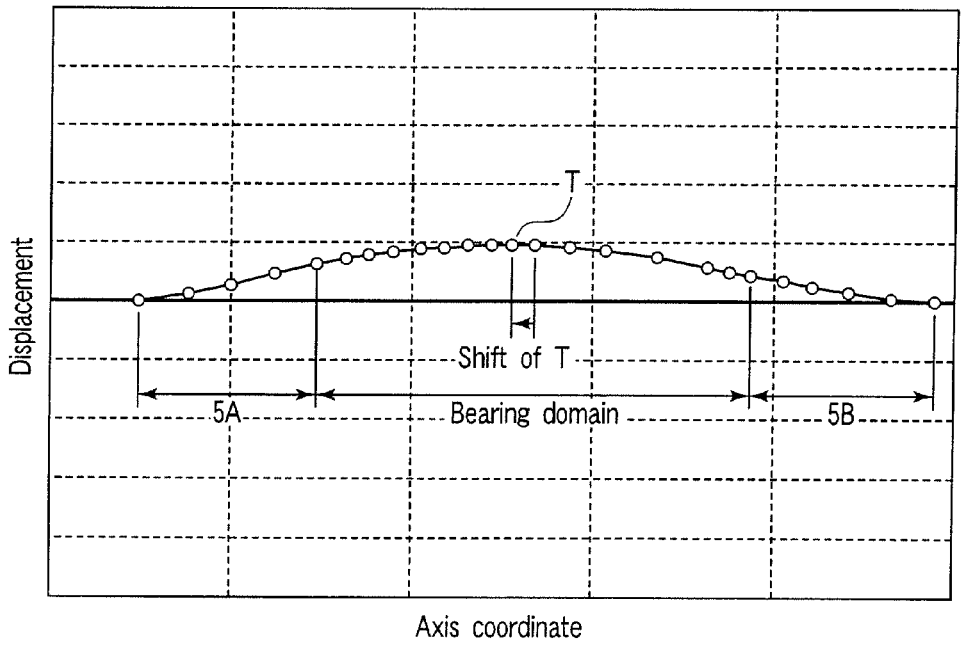
FIG. 7 is a graph schematically showing the deformation curve of the stationary shaft due to the centrifugal force applied to the rotary structure in a configuration that the stationary shaft is supported stationary and incapable of tilting and the first and second sections differ from each other in the bending rigidity as shown in FIG. 1.

FIG. 7 shows the deformation curve in the case where the bending rigidity of the first section 5A is made smaller than the bending rigidity of the second section 5B. It should be noted, however, that the two sections 5A and 5B are clamped stationary by the supporting sections 11 and 13 of the vacuum envelope 1, respectively, such that the sections 5A, 5B are incapable of tilting, and that the sections 5A and 5B are equal to each other in the size in the axial direction.

Compared with FIG. 4 showing the deformation curve for the comparative case, the peak T in the displacement amount of the deformation curve is moved to the left in the graph shown in FIG. 7 as in the graph of FIG. 5. In the graph shown in FIG. 7, the average value of the relative inclination amount between the rotary structure 17 and the stationary shaft 5 is 90% of the average value of the relative inclination amount shown in FIG. 4 directed to the comparative case. Similarly, it can be understood that, even if the centrifugal force is applied to the rotary body, a desired degree of parallelism can be maintained between the rotary structure 17 and the stationary shaft 5.

Further, it is possible to move sufficiently the peak T in the displacement amount of the deformation curve to the left as shown in FIG. 3 so as to be positioned on the first section 5A by (a) making the first section 5A capable of tilting about the supporting and holding structure 9 of the vacuum envelope 1 acting as a fulcrum, (b) making the size in the axial direction of the first section 5A between the thrust bearing Sa and the supporting and holding structure 9 longer than the size in the axial direction of the second section 5B between the thrust bearing Sb and the supporting section 13, and (c) making the bending rigidity in the first section 5A smaller than the bending rigidity in the second section 5B.

As a result, the radial bearings and the thrust bearings are arranged on the inclined plane on one side (on the right side of the peak T in the drawing) of the deformation curve of the stationary shaft 5 so as to maintain a desired degree of parallelism between the rotary structure 17 and the stationary shaft 5.

As described above, in the rotary anode type X-ray tube according to the first embodiment of the present invention, a satisfactory lubricating state is realized between the rotary structure 17 and the stationary shaft 5 so as to make it possible to permit the rotary structure 17 to rotate smoothly and stably. It follows that it is possible to ensure a reliability in the rotary mechanism of the rotary anode type X-ray tube.

A rotary anode type X-ray tube according to a second embodiment of the present invention will now be described with reference to FIG. 8.

Figure 8:
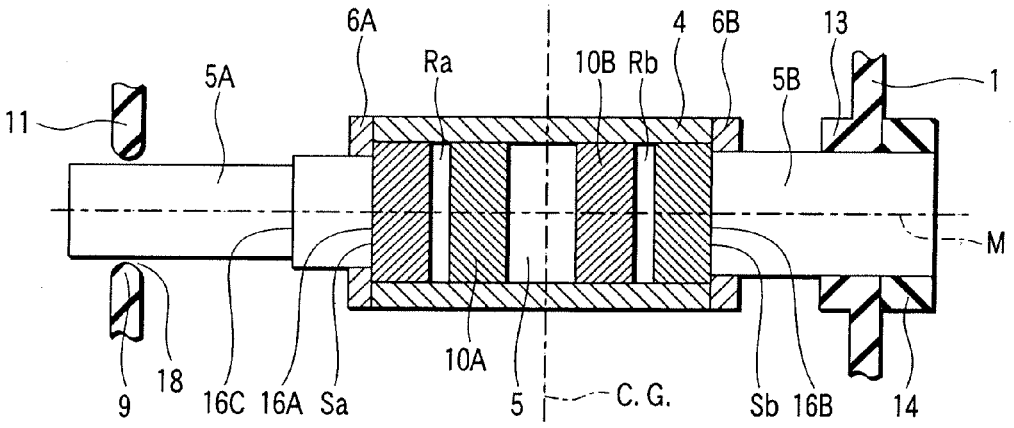
FIG. 8 is a cross sectional view schematically showing the stationary shaft incorporated in a rotary anode type X-ray tube according to a second embodiment of the present invention and the supporting structure of the stationary shaft.

FIG. 8 shows the rotary mechanism consisting of the radial bearings Ra, Rb, the thrust bearings Sa, Sb, the cylindrical portion 4, the stationary shaft 5, and the sections 5A, 5B of the stationary shaft 5, which are included in the rotary anode type X-ray tube shown in FIG. 1, and the supporting structure thereof. Those portions shown in FIG. 8 which correspond to the portions shown in FIG. 1 are denoted by the same reference numerals so as to avoid the overlapping description.

In the rotary anode type X-ray tube shown in FIG. 8, the first section 5A is formed of several portions differing from each other in the value of the bending rigidity. In the example shown in FIG. 8, the first section 5A is formed such that first and second shafts differing from each other in the diameter are joined to each other in a manner to form a stepped portion. However, the construction of the first section 5A is not limited to the construction shown in FIG. 8. To be more specific, it is also possible for the first section 5A to be formed of a plurality of sections differing from each other in the value of the bending rigidity. It is also possible for the first section 5A to be formed such that the value of the bending rigidity of the first section 5A is changed continuously. On the other hand, the second section 5B, which is supported stationary so as to be incapable of tilting, is formed such that the value of the bending rigidity is substantially uniform over the entire region of the second section 5B.

The line of the center of gravity passing through the center of gravity C.G. in the direction of the rotary axis of the rotary body passes through a region on the radial bearing. In case that the rotary structure 17 including two radial bearings Ra, Rb, the line of the center of gravity passes through the regions on the two radial bearings Ra, Rb or through a region between the two radial bearings Ra, Rb. In the arrangement shown in FIG. 8, the line of the center of gravity passes through a region between the radial bearings Ra and Rb.

The first section 5A which is supported with tilting capability is designed to permit the smallest value of the bending rigidity at the portions having different values of the bending rigidity to be set smaller than the bending rigidity of the second section SB that is supported stationary, and to permit that portion of the first section 5A which has a bending rigidity smaller than that of the second section 5B to be longer than the second section 5B. To be more specific, the construction shown in FIG. 8 is designed to permit the bending rigidity in the small-diameter portion of the first section 5A positioned between a stepped plane 16C and the supporting and holding structure 9 or in the entire region of the first section 5A to be smaller than the bending rigidity of the second section 5B and to permit that portion of the first section 5A which has a bending rigidity smaller than that of the second section 5B to be longer than the second section 5B.

According to the structure shown in FIG. 8, a desirable degree of parallelism between the rotary structure 17 and the stationary shaft 5 can be maintained even if the rotary anode type X-ray tube is incorporated in a CT apparatus so as to permit the centrifugal force to be imparted to the rotary structure 17.

Figure 9:
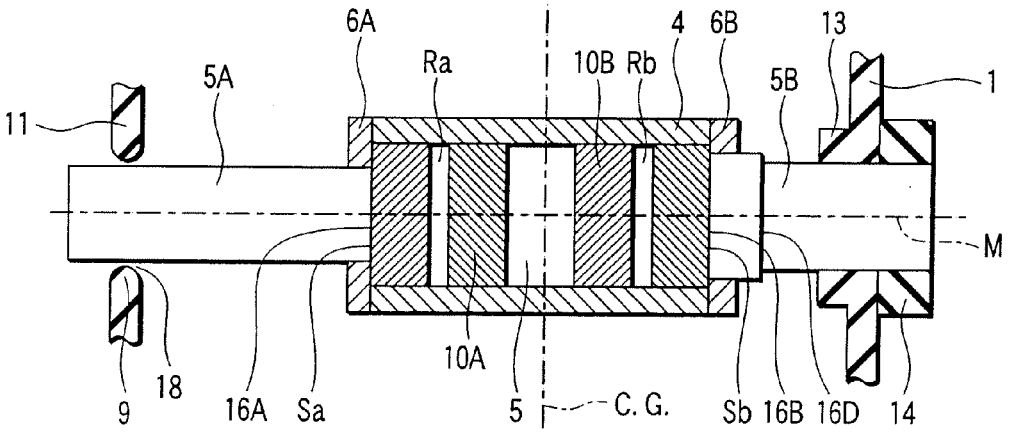
FIG. 9 is a cross sectional view schematically showing the stationary shaft incorporated in a rotary anode type X-ray tube according to a third embodiment of the present invention and the supporting structure of the stationary shaft.

A rotary anode type X-ray tube according to a third embodiment of the present invention will now be described with reference to FIG. 9. Specifically, FIG. 9 shows the rotary mechanism included in the rotary anode type X-ray tube and the supporting structure thereof like FIG. 8. Those portions shown in FIG. 9 which correspond to the portions shown in FIG. 1 are denoted by the same reference numerals so as to avoid the overlapping description.

In the structure shown in FIG. 9, the first section 5A which is supported with tilting capability has a uniform bending rigidity over the entire region. On the other hand, the second section 5B that is supported stationary is formed of several portions differing from each other in the value of the bending rigidity. In the example shown in FIG. 9, the second section 5B includes first and second shaft portions that are joined to each other in a manner to form a stepped portion. However, the construction of the second section 5B is not limited to that shown in FIG. 9. Specifically, it is possible for the second section 5B to include a plurality of shaft portions differing from each other in the value of the bending rigidity. It is also possible for the second section 5B to be formed such that the bending rigidity of the second section SB is changed continuously.

The line of the center of gravity passing through the center of gravity C.G. of the rotary body passes through a region on the radial bearing. In case that the rotary structure 17 including two radial bearings Ra, Rb, the line of the center of gravity passes through the regions on the two radial bearings Ra, Rb or passes through a region between the two radial bearings Ra, Rb. In the arrangement shown in FIG. 9, the line of the center of gravity passes through a region between the radial bearings Ra and Rb.

It should also be noted that the first section 5A is designed to permit the bending rigidity thereof to be smaller than the smallest bending rigidity in the second section 5B that is supported without tilting capability and to permit the first section 5A to be longer than that portion of the second section 5B which has the smallest bending rigidity. To be more specific, the rotary anode type X-ray tube is designed to permit the bending rigidity of the first section 5A to be smaller than the bending rigidity in the small-diameter portion of the second section 5B positioned between a stepped plane 16D and the supporting section 13, and to permit the first section 5A to be longer than the small-diameter portion of the second section 5B noted above.

According to the structure shown in FIG. 9, a desired degree of parallelism can be maintained between the rotary structure 17 and the stationary shaft 5, even if the rotary anode type X-ray tube is incorporated in a CT apparatus so as to permit the centrifugal force to be imparted to the rotary body.

Figure 10:
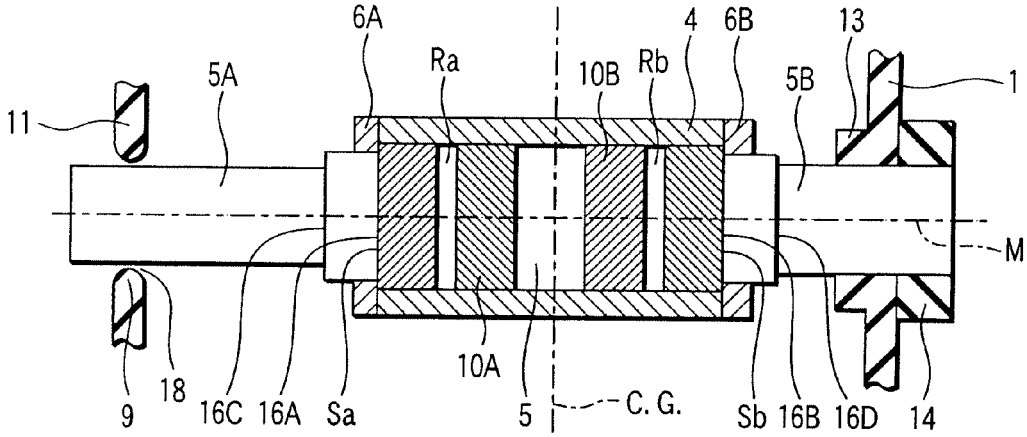
FIG. 10 is a cross sectional view schematically showing the stationary shaft incorporated in a rotary anode type X-ray tube according to a fourth embodiment of the present invention and the supporting structure of the stationary shaft.

A rotary anode type X-ray tube according to a fourth embodiment of the present invention will now be described with reference to FIG. 10. Specifically, FIG. 10 shows the rotary mechanism included in the rotary anode type X-ray tube and the supporting structure thereof like FIG. 8. Those portions shown in FIG. 10 which correspond to the portions shown in FIG. 1 are denoted by the same reference numerals so as to avoid the overlapping description.

In the structure shown in FIG. 10, each of the first section 5A and the second section 5B is formed of two shaft portions differing from each other in the value of the bending rigidity. Also, in the example shown in FIG. 10, each of the sections 5A and 5B includes first and second shaft portions which are joined to each other to form a stepped portion. However, the construction of each of the sections 5A and SB is not limited to that shown in FIG. 10. Specifically, it is possible for each of the sections 5A and 5B to include a plurality of shaft portions differing from each other in the value of the bending rigidity. It is also possible for each of the sections 5A and 5B to be formed such that the bending rigidity of each of the sections 5A and 5B is changed continuously.

The line of the center of gravity passing through the center of gravity C.G. of the rotary body passes through a region on the radial bearing. In case that the rotary structure 17 including two radial bearings Ra, Rb, the line of the center of gravity passes through the regions on the two radial bearings Ra, Rb or passes through a region between the two radial bearings Ra, Rb. In the arrangement shown in FIG. 10, the line of the center of gravity passes through a region between the radial bearings Ra and Rb.

The smallest value of the bending rigidity in the shaft portion of the first section 5A is set smaller than the smallest bending rigidity in the shaft portion of the second section SB. In addition, the shaft portion of the first section 5A having a bending rigidity smaller than the smallest bending rigidity of the second section 5B is set longer than the shaft portion of the second section 5B having the smallest bending rigidity. To be more specific, the construction shown in FIG. 10 is designed to permit the bending rigidity in the small-diameter portion of the first section 5A between the stepped plane 16C and the supporting and holding structure 9 or in the entire region of the first section 5A to be smaller than the bending rigidity in the small diameter portion of the second section 5B between the stepped plane 16D and the supporting and holding structure 13, and to permit the shaft portion of the first section 5A, which has a bending rigidity smaller than that of the small-diameter portion of the second section 5B, to be longer than the small-diameter portion of the second section 5B.

According to the construction described above, a desirable degree of parallelism between the rotary structure 17 and the stationary shaft 5 can be maintained even if the rotary anode type X-ray tube is incorporated in a CT apparatus so as to permit a centrifugal force to be imparted to the rotary body.

Figure 11:
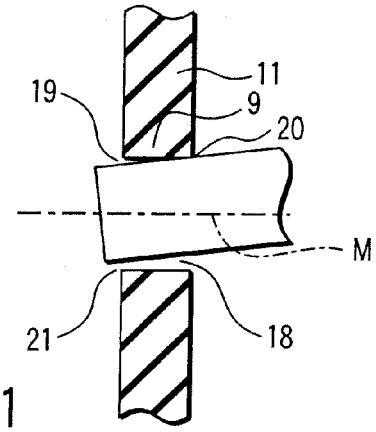
FIG. 11 is a cross sectional view schematically showing a part of the stationary shaft and a part of the supporting structure of the stationary shaft incorporated in a rotary anode type X-ray tube according to a fifth embodiment of the present invention.

A rotary anode type X-ray tube according to a fifth embodiment of the present invention will now be described with reference to FIG. 11. Specifically, FIG. 11 shows the construction of a part of the supporting structure included in the rotary anode type X-ray tube like FIG. 8. Those portions in FIG. 11 which correspond to the portions shown in FIG. 1 are denoted by the same reference numerals so as to avoid the overlapping description.

In the supporting structure shown in FIG. 11, an annular flat surface 19 is formed in that portion of the supporting and holding structure 9 which is positioned to face the first section 5A. A fringe having an appropriate curvature radius is applied to edges 20 and 21 of the annular flat surface 19 so as to suppress the abrasion and the generation of rubbish caused by the contact with the first section 5A capable of tilting. Also, a gap 18 is provided between the first section 5A capable of tilting and the supporting and holding structure 9.

Figure 12:
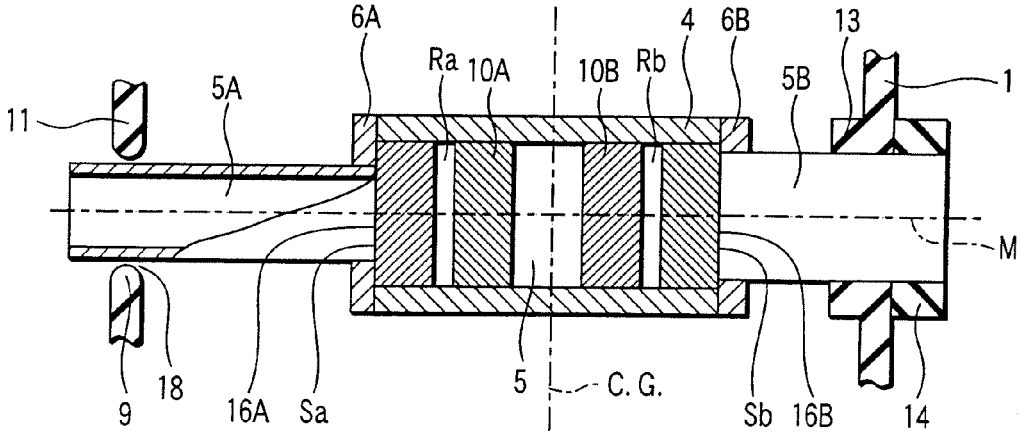
FIG. 12 is a cross sectional view schematically showing the stationary shaft incorporated in a rotary anode type X-ray tube according to a sixth embodiment of the present invention and the supporting structure of the stationary shaft.

A rotary anode type X-ray tube according to a sixth embodiment of the present invention will now be described with reference to FIG. 12. Specifically, FIG. 12 shows the rotary mechanism included in the rotary anode type X-ray tube and the supporting structure thereof like FIG. 3. Those portions shown in FIG. 12 which correspond to the portions shown in FIG. 1 are denoted by the same reference numerals so as to avoid the overlapping description.

In the structure shown in FIG. 12, the first section 5A is so formed into a hollow cylindrical shape as to have a first bending rigidity which is smaller than a second bending rigidity of the second section 5B. Thus, according to the structure shown in FIG. 12, a desirable degree of parallelism between the rotary structure 17 and the stationary shaft 5 can be maintained even if the rotary anode type X-ray tube is incorporated in a CT apparatus so as to permit the centrifugal force to be imparted to the rotary structure 17.

Each of the embodiments described above does not limit the technical scope of the present invention. For example, the technical idea of the present invention can also be applied to an embodiment comprising only one radial bearing. Also, it is possible for the thrust bearing to be formed between an edge surface of an annular expanded portion formed on the stationary shaft 5 and the rotary structure. It is also possible for the first section 5A to be supported by the vacuum envelope by, for example, a pin or a hinge that permits holding the first section 5A such that the first section 5A is capable of tilting and to be supported by the supporting section of the vacuum envelope. It is also possible to use, for example, a hollow shaft having an annular cross section for forming the stationary shaft 5 or the sections 5A, 5B. In this case, it is possible to lower the bending rigidity of, for example, the first section 5A by decreasing, for example, the outer diameter of the shaft while increasing the inner diameter of the shaft. It is also possible to increase the bending rigidity of the second section 5B by increasing the outer diameter of the shaft while decreasing the inner diameter of the shaft. It is also possible for the first section 5A and the second section 5B to be formed of materials differing from each other and for each of the sections 5A and 5B to be formed of a plurality of portions differing from each other in the material. In this case, it is possible to lower the bending rigidity of, for example, the first section 5A by using, for example, a material having a smaller Young's modulus, and to increase the bending rigidity of, for example, the second section 5B by using a material having a larger Young's modulus. Further, it is possible for the stationary member 14 of the second section 5B to constitute a part of the housing having the vacuum envelope housed therein.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotary anode X-ray tube, comprising:

a vacuum envelope;

a cathode arranged within the vacuum envelope, which emits an electron beam;

a rotary anode arranged within the vacuum envelope, on which the electron beam impinges to generate X-rays;

a rotary structure supporting the rotary anode, including a cylindrical portion having two open ends and a rotor section provided for generating a rotating force to rotate the cylindrical portion together with the rotary anode, the rotary anode fixed to the cylindrical portion and arranged within the vacuum envelope, the rotary anode being arranged around the cylindrical portion so that a center of gravity of the rotary anode with the rotary structure is in the cylindrical portion;

a stationary shaft having two ends and an axis, and including a middle section having two ends, which is fitted into the cylindrical portion, a first section extending along the axis between one end of the middle section and one end of the stationary shaft and having a first shaft length, a second section extending along the axis between the other end of the middle section and the other end of the stationary shaft and having a second shaft length, the first shaft length being larger than the second shaft length, a transverse stiffness of the second section being larger than a transverse stiffness of the first section, and the center of gravity is positioned in the middle section;

a dynamic pressure radial bearing arranged between the cylindrical portion and the middle section of the stationary shaft; and first and second supporting sections arranged within and fixed to the vacuum envelope, the second supporting section fixedly supporting the second section such that the second section does not slide, and the first supporting section supporting the first section in such a manner that the first section is configured to slide on the first supporting section.

2. The rotary anode X-ray tube according to claim 1, wherein a bending rigidity of the first section is smaller than a bending rigidity of the second section.

3. The rotary anode X-ray tube according to claim 1, wherein the stationary shaft is columnar, and a diameter of the first section is smaller than a diameter of the second section.

4. The rotary anode X-ray tube according to claim 1, wherein the first section is in a form of a hollow cylinder having a void formed therein.

5. The rotary anode X-ray tube according to claim 2, wherein the first section is formed of a first material having a first Young's modulus, and the second section is formed of a second material having a second Young's modulus.

6. The rotary anode X-ray tube according to claim 1, wherein the first section of the stationary shaft is capable of tilting at the first supporting section.

7. The rotary anode X-ray tube according to claim 1, wherein the stationary shaft is deformed due to a centrifugal force applied to the rotary anode in such a way that a peak of displacement distribution along the axis of the stationary shaft is located in the first section of the stationary shaft.

8. The rotary anode X-ray tube according to claim 1, further comprising:

a second dynamic pressure radial bearing arranged between the cylindrical portion and the middle section of the stationary shaft, the center of gravity of the rotary anode and the rotary structure being positioned between the first and the second radial bearings.

9. The rotary anode X-ray tube according to claim 8, wherein the stationary shaft is deformed due to a centrifugal force applied to the rotary anode in such a way that a peak of displacement distribution along the axis of the stationary shaft is located in the radial bearing closer to the first section of the stationary shaft.

10. The rotary anode X-ray tube according to claim 8, wherein the stationary shaft is deformed due to a centrifugal force applied to the rotary anode in such a way that a peak of displacement distribution along the axis of the stationary shaft is located in the first section of the stationary shaft.

11. A computed tomography apparatus comprising:

a rotary anode X-ray tube including:

a vacuum envelope;

a cathode arranged within the vacuum envelope, which emits an electron beam;

a rotary anode arranged within the vacuum envelope, on which the electron beam impinges to generate X-rays;

a rotary structure supporting the rotary anode, including a cylindrical portion having two open ends and a rotor section provided for generating a rotating force to rotate the cylindrical portion together with the rotary anode, the rotary anode fixed to the cylindrical portion and arranged within the vacuum envelope, the rotary anode being arranged around the cylindrical portion so that a center of gravity of the rotary anode with the rotary structure is in the cylindrical portion;

a stationary shaft having two ends and an axis, and including a middle section having two ends, which is fitted into the cylindrical portion, a first section extending along the axis between one end of the middle section and one end of the stationary shaft and having a first shaft length, a second section extending along the axis between the other end of the middle section and the other end of the stationary shaft and having a second shaft length, the first shaft length being larger than the second shaft length, a transverse stiffness of the second section being larger than a transverse stiffness of the first section, and the center of gravity is positioned in the middle section;

a dynamic pressure radial bearing arranged between the cylindrical portion and the middle section of the stationary shaft; and first and second supporting sections arranged within and fixed to the vacuum envelope, the second supporting section fixedly supporting the second section such that the second section does not slide, and the first supporting section supporting the first section in such a manner that the first section is configured to slide on the first supporting section.

* * * * *